US005337062A

United States Patent [19]

Sherwood et al.

[11] Patent Number: 5,337,062

[45] Date of Patent: Aug. 9, 1994

[54] DEPLOYABLE SATELLITE ANTENNA FOR USE ON VEHICLES

[75] Inventors: William J. Sherwood, West Burlington; Charles E. Rodeffer, Burlington, both of Iowa

[73] Assignee: Winegard Company, Burlington, Iowa

[21] Appl. No.: 977,907

[22] Filed: Nov. 18, 1992

[51] Int. Cl.[5] ..... H01Q 1/32

[52] U.S. Cl. ..... 343/711; 343/761; 343/765; 343/882

[58] Field of Search ..... 343/711–714, 343/878, 880, 881, 882, 840, 765, 766, 763, 915; 248/183; H01Q 1/32, 1/08, 13/00, 15/20

[56] References Cited

U.S. PATENT DOCUMENTS

| | | | |
|---|---|---|---|
| 3,412,404 | 11/1968 | Bergling | 343/762 |
| 3,587,104 | 6/1971 | Budrow et al. | 343/714 |
| 3,665,477 | 5/1972 | Budrow et al. | 343/714 |
| 3,739,387 | 6/1973 | Budrow et al. | 343/714 |
| 4,185,288 | 1/1980 | Dosch et al. | 343/713 |
| 4,309,708 | 1/1982 | Sayovitz | 343/713 |
| 4,490,726 | 12/1984 | Weir | 343/840 |
| 4,602,259 | 7/1986 | Shepard | 343/359 |
| 4,663,633 | 5/1987 | Wilson | 343/714 |
| 4,710,778 | 12/1987 | Radov | 343/882 |
| 4,811,026 | 3/1989 | Bissett | 343/766 |
| 4,833,484 | 5/1989 | Garrood et al. | 343/781 CA |
| 4,868,578 | 9/1989 | Bruinsma et al. | 343/882 |
| 4,887,091 | 12/1989 | Yamada | 343/714 |
| 4,937,587 | 6/1990 | Tsuda | 343/766 |

FOREIGN PATENT DOCUMENTS

| | | | |
|---|---|---|---|
| 55-53903 | 4/1980 | Japan . | |
| 60-233905 | 11/1985 | Japan . | |
| 60-260205 | 12/1985 | Japan . | |
| 0260207 | 12/1985 | Japan | 343/713 |

*Primary Examiner*—Donald Hajec
*Assistant Examiner*—Tan Ho
*Attorney, Agent, or Firm*—Dorr, Carson, Sloan, & Peterson

[57] ABSTRACT

A deployable satellite antenna system permits an antenna with elevation and azimuth control to be mounted to the roof of a vehicle. The elevation control assembly for the antenna system has a base with two parallel tracks and a slider that moves along these tracks. The antenna is connected to a support frame pivotally attached to the slider. Pivot arms are pivotally attached between the reflector and the base adjacent to the parallel tracks. The elevational position of the antenna is adjusted by a motor that controls the position of the slider along the parallel tracks between a stowed position in which the antenna is stowed facing the vehicle and a deployed position in which the antenna is rotated to a maximum elevational angle. The azimuth of the antenna is controlled by a rotating assembly mounted to the roof of the vehicle beneath the base of the elevation control assembly.

17 Claims, 10 Drawing Sheets

DEPLOYABLE SATELLITE ANTENNA FOR USE ON VEHICLES

BACKGROUND OF THE INVENTION

1. Field of the Invention

The present invention relates generally to the field of satellite antennas. More specifically, the present invention discloses a deployable satellite antenna intended especially for use on a vehicle, such as a recreational vehicle.

2. Statement of the Problem

Antennas have enjoyed increasing popularity in recent years for the purpose of receiving television signals from orbiting satellites. Satellite antennas are perhaps most widely used in small towns and rural areas that are not served by cable television systems. However, a market for satellite antennas also exists for recreational vehicles, such as motor homes, campers, trailers, mobile homes, and the like, that can be moved to remote locations not serviced by conventional cable television systems. A number of special considerations come into play when adapting an antenna for use on such a vehicle. First, it should be possible to readily stow the antenna while the vehicle is traveling to minimize aerodynamic resistance and to reduce the risk of damage to the antenna, its ancillary equipment, and the vehicle resulting from aerodynamic loads and other road hazards. Second, the antenna should be able to be positioned to virtually any azimuth and elevation. With a conventional ground-based antenna, it is sometimes possible to accept a limited range of azimuths or elevations for an antenna given the known relative locations of the satellites and the antenna. In the case of an antenna mounted on a vehicle that can be moved over a wide geographic area and parked in any azimuth orientation, such restrictions are not acceptable and a full range of possible azimuth and elevation positions are necessary for the antenna. Third, the antenna system should be relatively compact while stowed and while deployed, so as not to interfere with any other objects (e.g., the air conditioning unit, vents, or luggage rack) located on the roof of a typical recreational vehicle. Finally, the system should be designed to use conventional electric motors to accurately control the motion of the mechanical linkages to position the antenna without discontinuities or singularities.

A number of deployable antennas have been invented in the past, including the following:

| Inventor | Patent No. | Issue Date |
|---|---|---|
| Yamada | 4,887,091 | Dec. 12, 1989 |
| Bissett | 4,811,026 | Mar. 7, 1989 |
| Radov | 4,710,778 | Dec. 1, 1987 |
| Wilson | 4,663,633 | May 5, 1987 |
| Shepard | 4,602,259 | July 22, 1986 |
| | Japan 60-260207 | Dec. 23, 1985 |
| | Japan 60-260205 | Dec. 23, 1985 |
| | Japan 60-233905 | Nov. 20, 1985 |
| Weir | 4,490,726 | Dec. 25, 1984 |
| Sayovitz | 4,309,708 | Jan. 5, 1982 |
| | Japan 55-53903 | Apr. 19, 1980 |
| Budrow, et al. | 3,739,387 | June 12, 1973 |
| Budrow, et al. | 3,665,477 | May 23, 1972 |
| Budrow, et al. | 3,587,104 | June 22, 1971 |
| Bergling | 3,412,404 | Nov. 19, 1968 |

Yamada discloses a receiving antenna for vehicles having a horizontally rotatable base plate with a main reflector tiltably attached to the edge of the base plate. A sub-reflector is mounted at the end of an arm extending from the base plate.

Bissett discloses a mobile satellite receiving antenna especially for use on recreational vehicles. A generally cylindrical collar extends upward from the vehicle roof. A parabolic reflector is hinged along an edge to a horizontal turntable within the collar so that the reflector may be rotated to a concave downward position to serve as a weather cover over the collar and also to provide smooth aerodynamic conditions during transport.

Radov discloses a modular earth station for satellite communications having a frame adapted to be installed in an inclined roof. A concave antenna is adjustably mounted to the frame and covered by a rigid canopy.

Wilson discloses a vehicle-mounted satellite antenna system having a base plate mounted on the vehicle roof, a support member rotatably secured to the base plate to permit rotation about a vertical axis, and a parabolic reflector pivotally secured to the support member. The feed arm is pivotally secured to one end of the parabolic reflector. When the antenna is deployed, the feed arm is automatically pivoted to a position wherein the feed horn is coincident with the focus of the reflector. When the antenna is returned to its rest position, the feed arm is automatically pivoted so that the feed horn is retained within the confines of the interior surface of the reflector.

Shepard discloses a polar mount for a parabolic satellite-tracking antenna.

Japanese Patent Nos. 60-260207 and 60-260205 disclose a vehicle-mounted antenna that can be stowed with the dish in a face-downposition against the roof of the vehicle.

Japanese Patent No. 60-233905 discloses an antenna having a feed arm that permits the feed horn to be stowed in a position adjacent to the surface of the dish.

Weir discloses a collapsible rooftop parabolic antenna. The antenna has a horizontal pivot that provides axial displacement if axial wind forces on the antenna exceed a predetermined limit. This limits the torque transmitted to the roof on which the antenna is mounted to a reasonably low level.

Sayovitz discloses a foldable disk antenna supported on a framework resting on the bed of a truck or trailer. Folding legs on the framework can be extended to contact the ground to support the antenna.

Japanese Patent No. 55-53903 discloses a satellite antenna with a tracking system that allows the antenna to be stowed.

The patents to Budrow, et al. disclose several embodiments of a TV antenna suitable for mounting upon the roof of a recreational vehicle. The direction of the antenna can be controlled from the vehicle interior. In addition, the antenna dipoles can be folded to a closed position when the vehicle is transported.

Bergling discloses a dish reflector having a stowed position.

3. Solution to the Problem

None of the prior art references uncovered in the search show a deployable antenna system having the structure of the present invention. In particular, the mechanism used to control and adjust the elevation of the antenna in the present invention is neither taught nor suggested by the prior art.

SUMMARY OF THE INVENTION

This invention provides a deployable satellite antenna system with elevation and azimuth controls that can be mounted to the roof of a vehicle. The elevation control assembly for the antenna system has a base with two parallel tracks and a slider that moves along these tracks. The antenna is connected to a support frame pivotally attached to the slider. Pivot arms are pivotally attached between the antenna and the base adjacent to the parallel tracks. The elevational position of the antenna is adjusted by a motor which controls the position of the slider along the parallel tracks between a stowed position in which the antenna is stowed facing the vehicle and a deployed position in which the antenna is rotated to a maximum elevational angle. The azimuth of the antenna is controlled by a rotating assembly mounted to the roof of the vehicle beneath the base of the elevation control assembly.

A primary object of the present invention is to provide a deployable antenna that can be readily mounted to the roof of a vehicle, such as a typical recreational vehicle.

Another object of the present invention is to provide a deployable antenna that can be stowed face down and that can be quickly and accurately positioned to virtually any azimuth and elevational orientation.

Yet another object of the present invention is to provide a deployable antenna that is relatively compact while stowed and while deployed, so as not to interfere with an other objects (e.g., the air conditioning unit, vents, or luggage rack) located on the roof of a recreational vehicle.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 8(*b*) is a partial front view providing further detail of the attachment of the feed frame assembly to the reflector.

FIG. 8(*c*) is an exploded perspective view of the feed frame assembly.

DETAILED DESCRIPTION OF THE INVENTION

Figure 1:
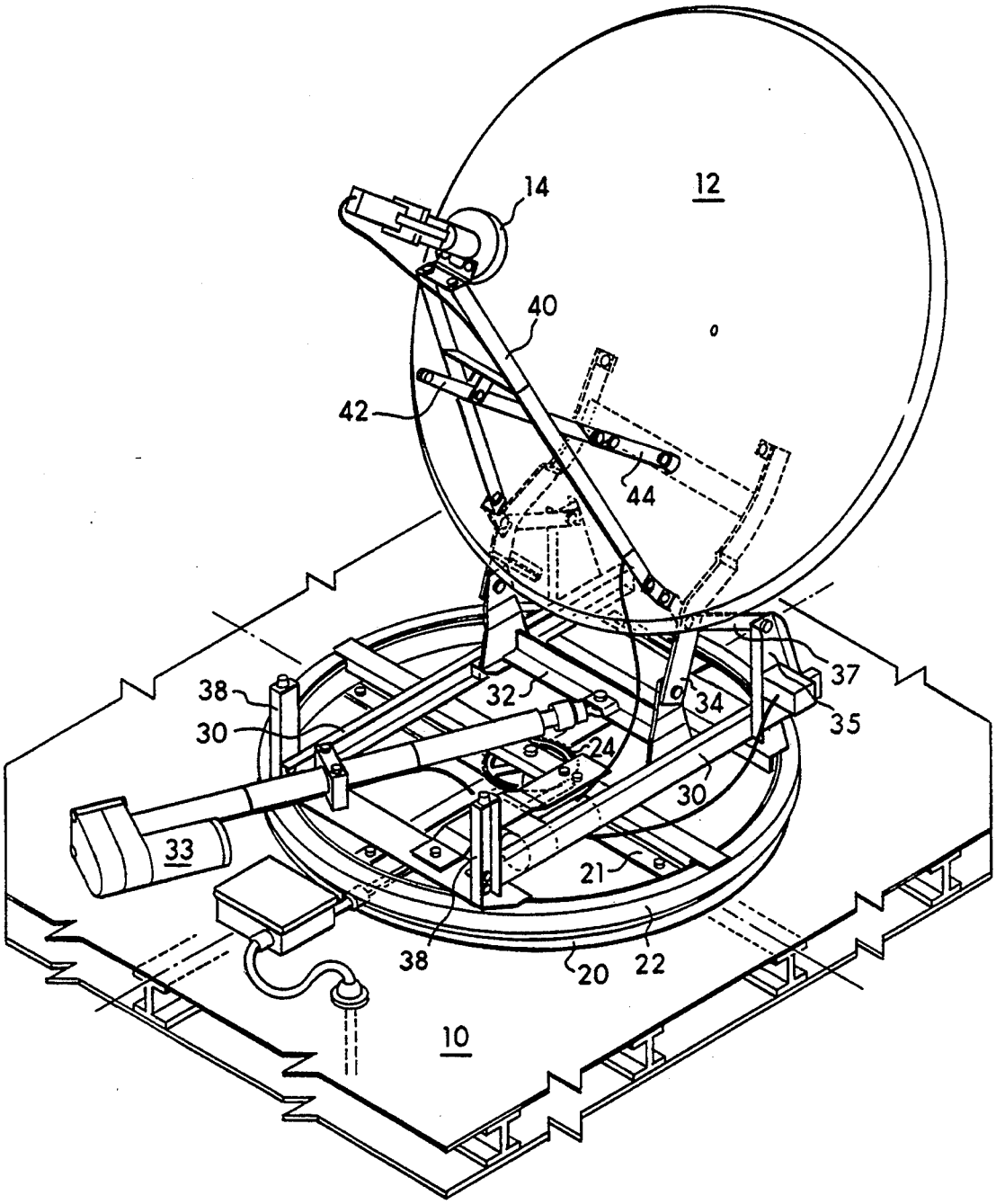
FIG. 1 is a perspective view of the entire satellite antenna assembly.

Turning to FIG. 1, the antenna system includes a reflector 12 having a substantially parabolic face to focus radio signals toward a predetermined focal point relative to the reflector 12. A feed horn 14 is positioned at this focal point when the antenna system is in its deployed state, as depicted in FIG. 1, to receive the radio signals reflected from the face of the reflector 12.

Figure 6:
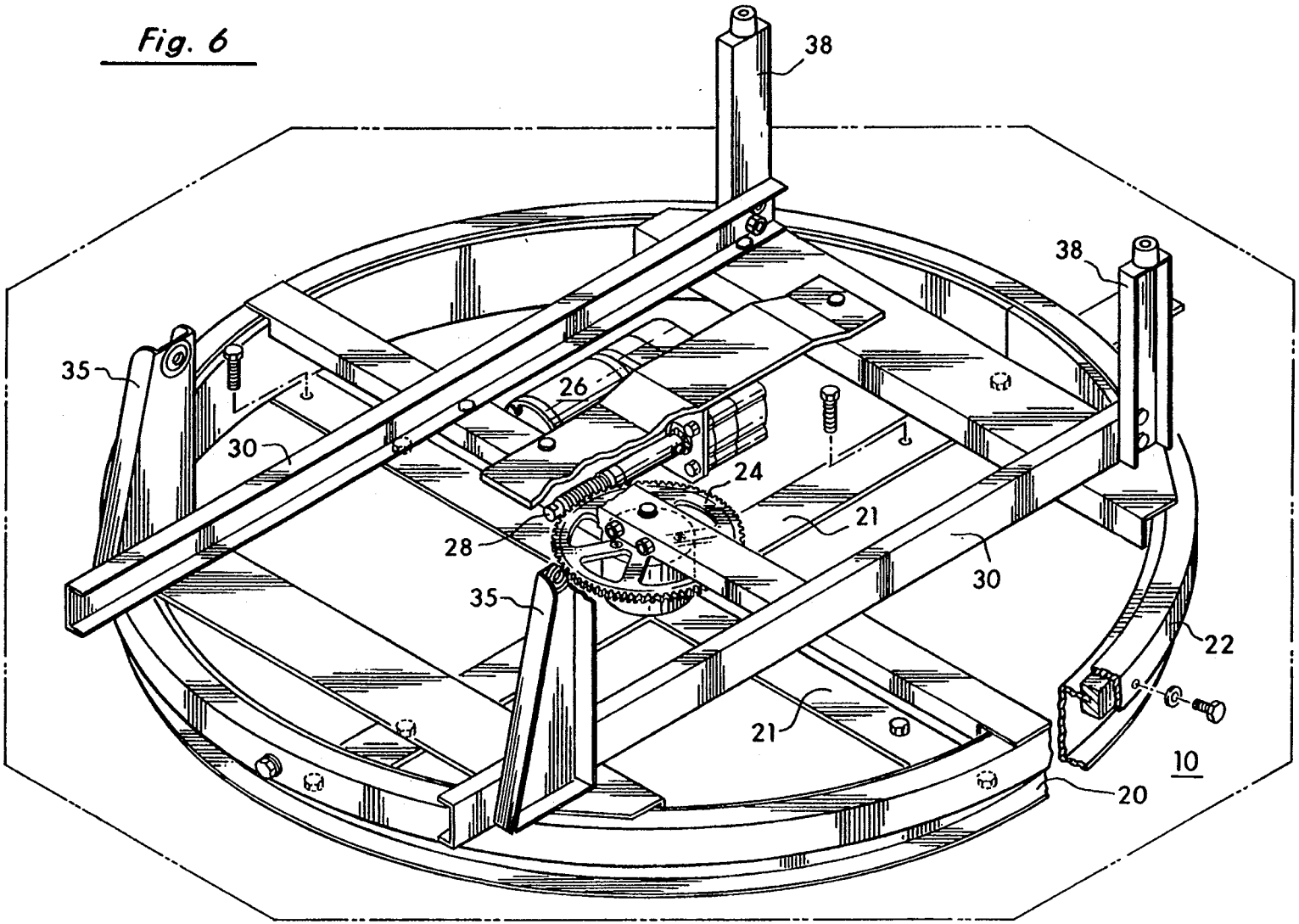
FIG. 6 is a perspective view of the azimuth control assembly of the antenna.
Figure 7:
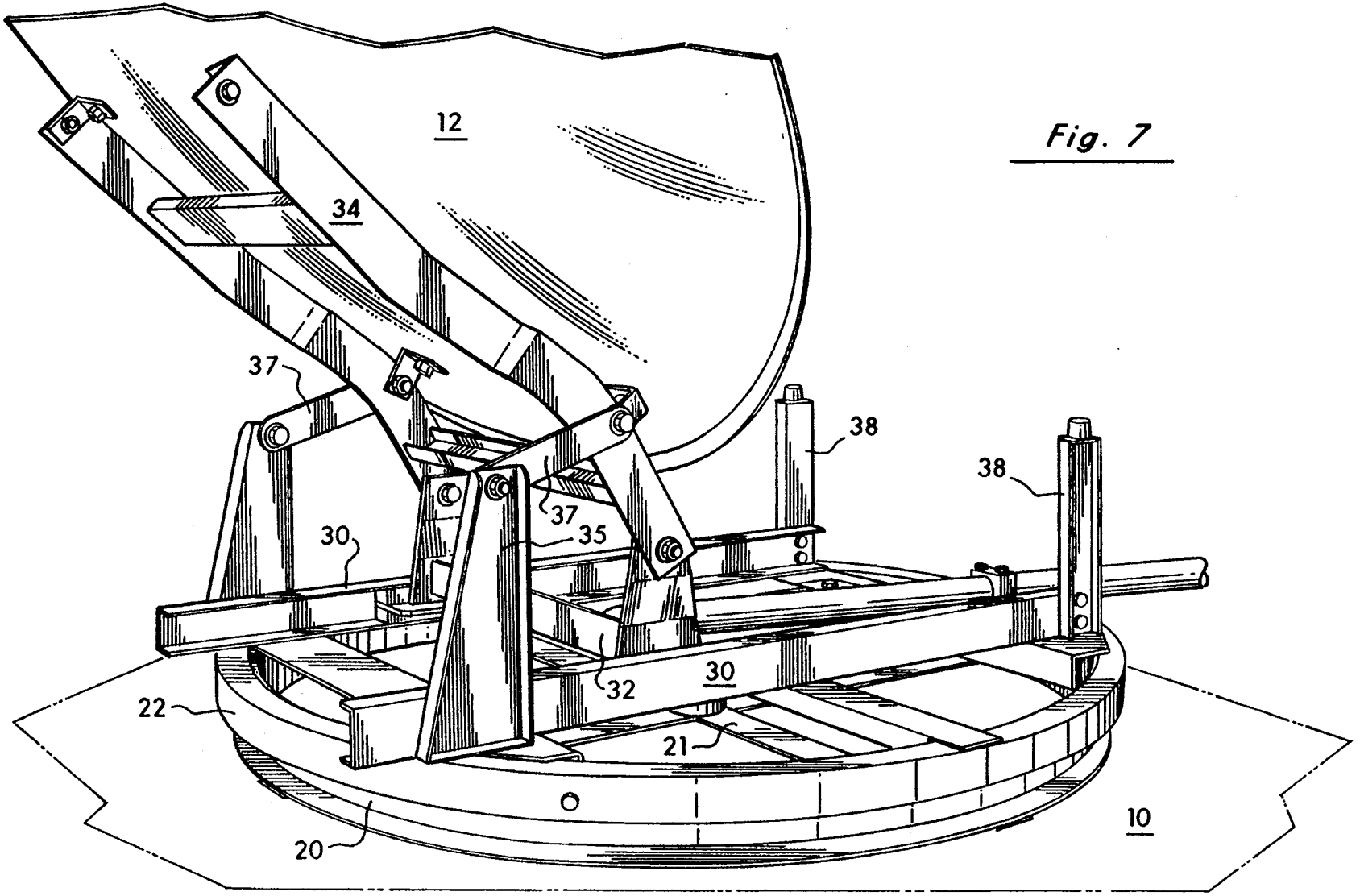
FIG. 7 is a rear perspective view of the fully deployed antenna corresponding to FIG. 5.

The entire system is attached to the roof of a vehicle 10, such as a recreational vehicle or a trailer, by means of a stationary frame 21. A stationary ring 20 is attached in turn to the stationary frame 21. A rotating ring 22 rides above the stationary ring 20, as shown most clearly in FIG. 6, and provides a rotating base or platform for the remainder of the system about a predetermined azimuth axis. In a typical installation, this azimuth axis extends vertically upward from the roof of the vehicle 10 through the center of the stationary ring 20 and the rotating ring 22. The azimuth orientation of the rotating ring 22 is controlled by an electric motor 26 attached to the rotating ring 22 which drives a worm 28 that meshes with the azimuth worm gear 24 attached to the stationary frame 21, as shown in FIG. 6. For example, the azimuth control motor 26 can be a DC motor that rotates the worm gear 28. The DC motor sends pulses back to its external controller as it rotates the azimuth assembly. These pulses are counted, and this information can then be used by the controller to monitor and control angular motion of the DC motor.

A number of parallel tracks 30 are mounted to the rotating ring 22 and extend substantially perpendicular to the azimuth axis. The preferred embodiment shown in the drawings uses two parallel tracks 30. A slider assembly 32 moves along these tracks 30. Alternatively, an assembly on wheels, or other equivalent means for translational motion along the parallel tracks 30 could be employed. The position of the slider assembly 32 along the tracks 30 is governed by a second motor 33. In the preferred embodiment, an electric motor drives a linear screw to adjust the horizontal position of the slider assembly 32 along the tracks 30. As will be described in further detail below, the motor 33 and slider assembly 32 control the elevational angle of the reflector 12.

Figure 2:
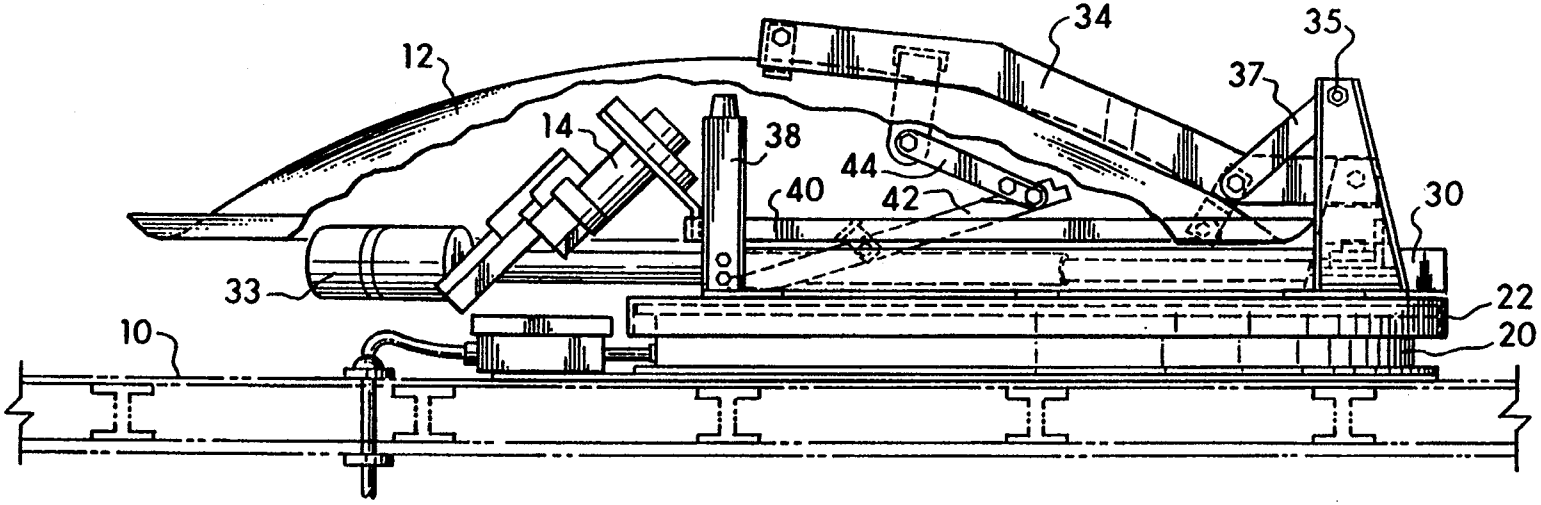
FIG. 2 is a side view of the antenna in its stowed position. The roof of the vehicle is shown in cross-section and a portion of the reflector is cut away to reveal the feed horn and the feed frame assembly.

The reflector 12 is supported by the upper portion of the reflector frame assembly 34 attached to the rear of the reflector 12. The lower portion of the reflector frame assembly 34 is pivotally attached to the slider assembly 32. This structure effectively permits elevational rotation of the reflector 12 about the lower end of the reflector frame assembly. Two supports 35 extend upward from the rotating ring 22 adjacent to parallel tracks 30. Two pivot arms 37 are connected between the reflector frame assembly 34 and the upper ends of the supports 35. In particular, the first end of each pivot arm 37 is pivotally attached to the upper end of one of the supports 35, while the other end is pivotally attached to the mid-section of the reflector frame assembly 34 adjacent to the rear of the reflector 12. Two additional front supports 38 with rubber bumpers extend upward from the rotating ring assembly 22 adjacent to the other ends of the parallel tracks 30. The reflector 12 rests against the rubber bumpers of the front supports 38 when stowed as shown in FIG. 2.

Figure 8A:
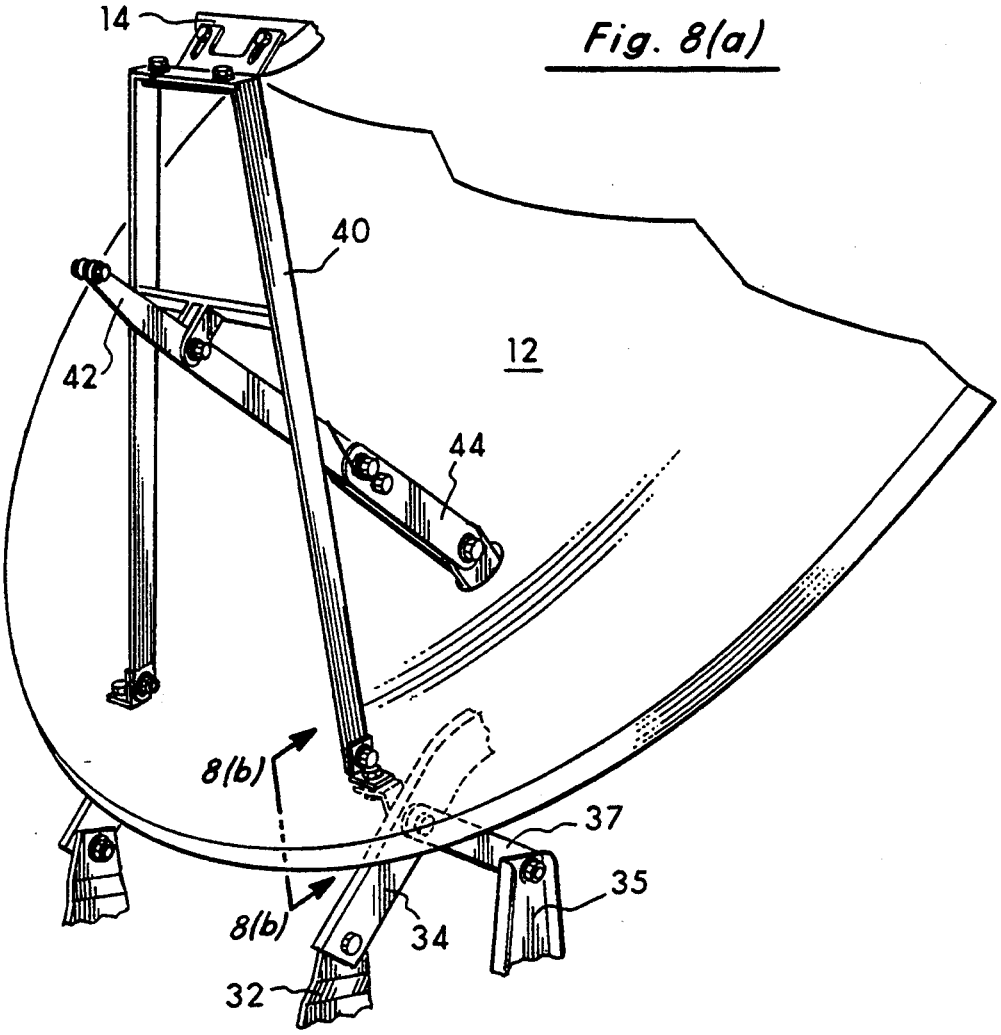
FIG. 8(*a*) is a perspective view showing the attachment of the feed frame assembly to the reflector.
Figure 8B:
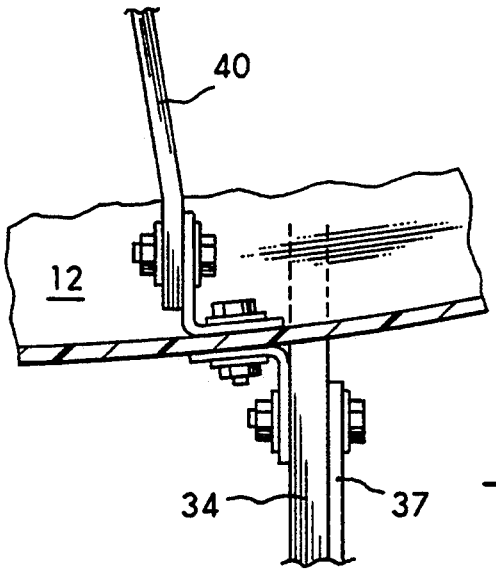
Figure 8C:
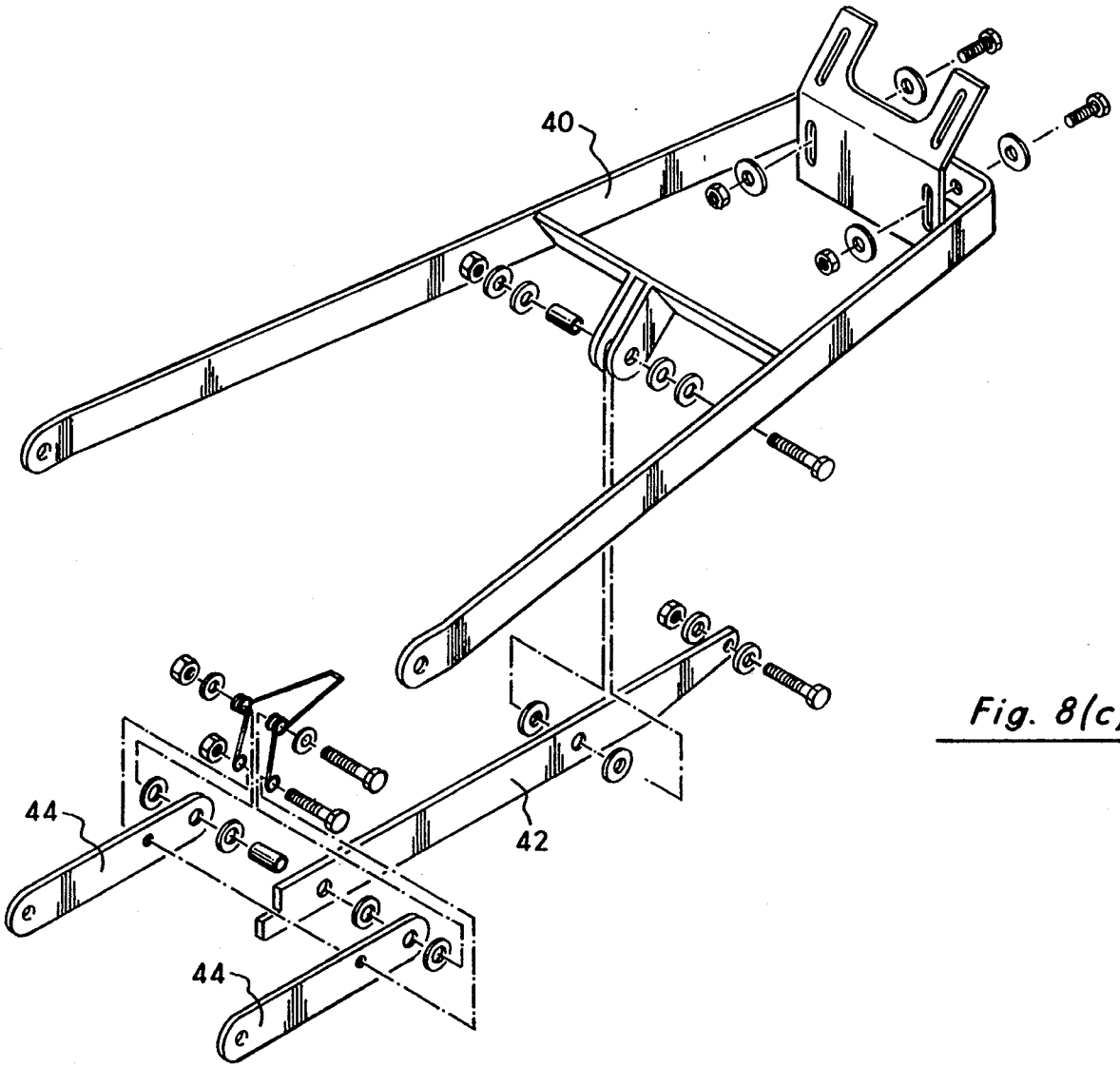

When the reflector 12 is deployed, the feed horn 14 must be positioned at the focal point of the reflector 12. The feed horn 14 is supported by the distal end of the feed frame assembly 40. The base of the feed frame assembly 40 is pivotally attached near the periphery of the reflector 12 as shown in FIGS. 1 through 5. A long feed pivot arm 42 is pivotally attached at its base end to the reflector 12 and is also pivotally or slidably attached at its mid-section to the mid-section of the feed frame assembly 40. Alternatively, the base end of the feed pivot arm 42 can be pivotally attached directly to the reflector frame assembly 34 through an opening in the reflector 12. The distal end of the feed pivot arm 42 is designed to come into contact with the base of the unit as the reflector 12 is rotated to its stowed position. This contact causes the feed frame assembly 40 to fold the feed horn 14 to a position adjacent to the face of the reflector 12 as the reflector moves toward its stowed position. In the preferred embodiment depicted in FIGS. 8(*a*) through 8(*c*), the feed pivot arm consists of two segments 42 and 44 connected together by a hinge and spring mechanism that tends to keep the segments in a co-linear relationship until the distal end of the outer segment comes into contact with the base.

Figure 3:
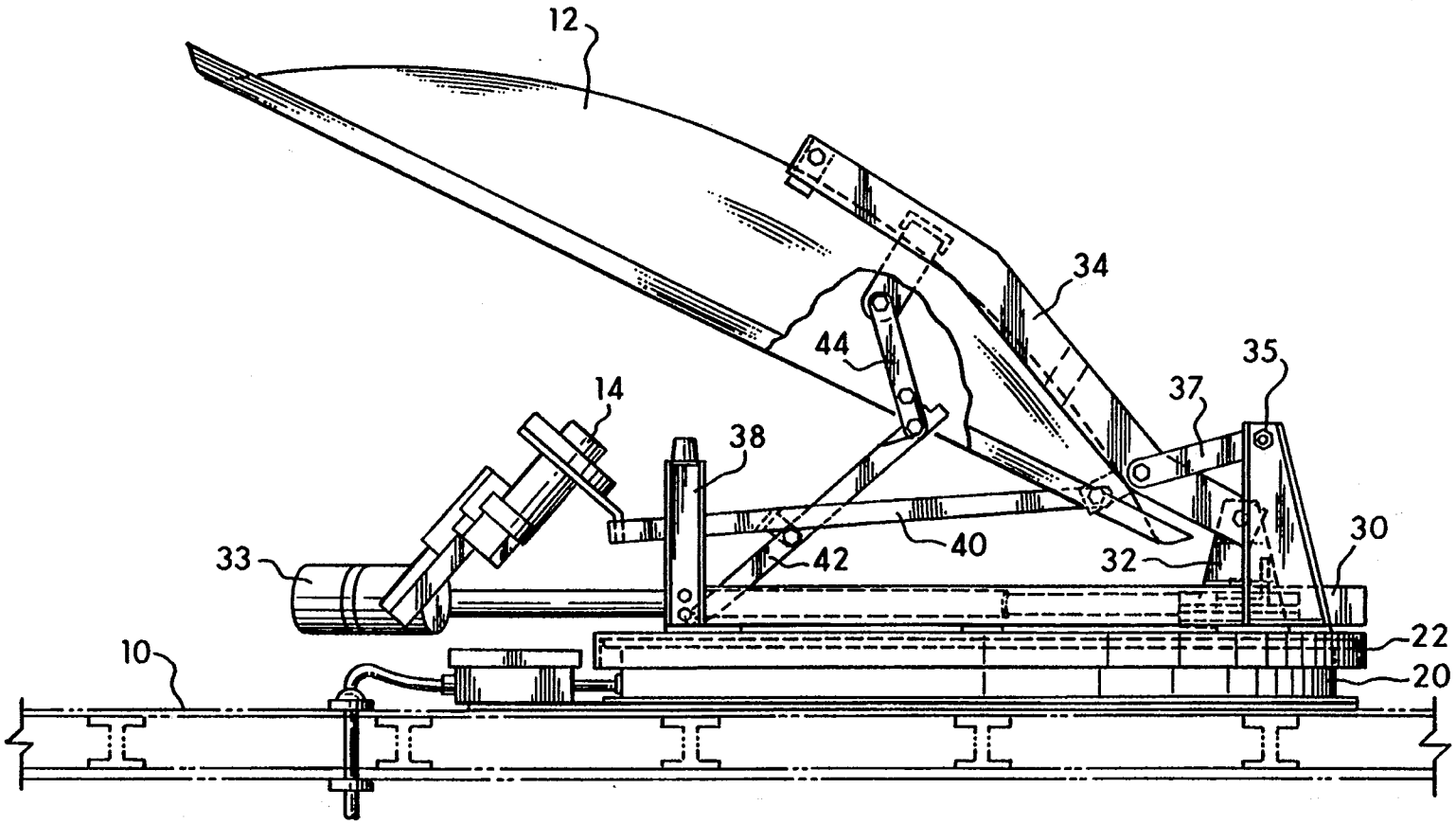
FIG. 3 is a side view of the antenna in a partially deployed position. The roof of the vehicle is shown in cross-section and a portion of the reflector is cut away to reveal the base of the feed frame assembly.
Figure 4:
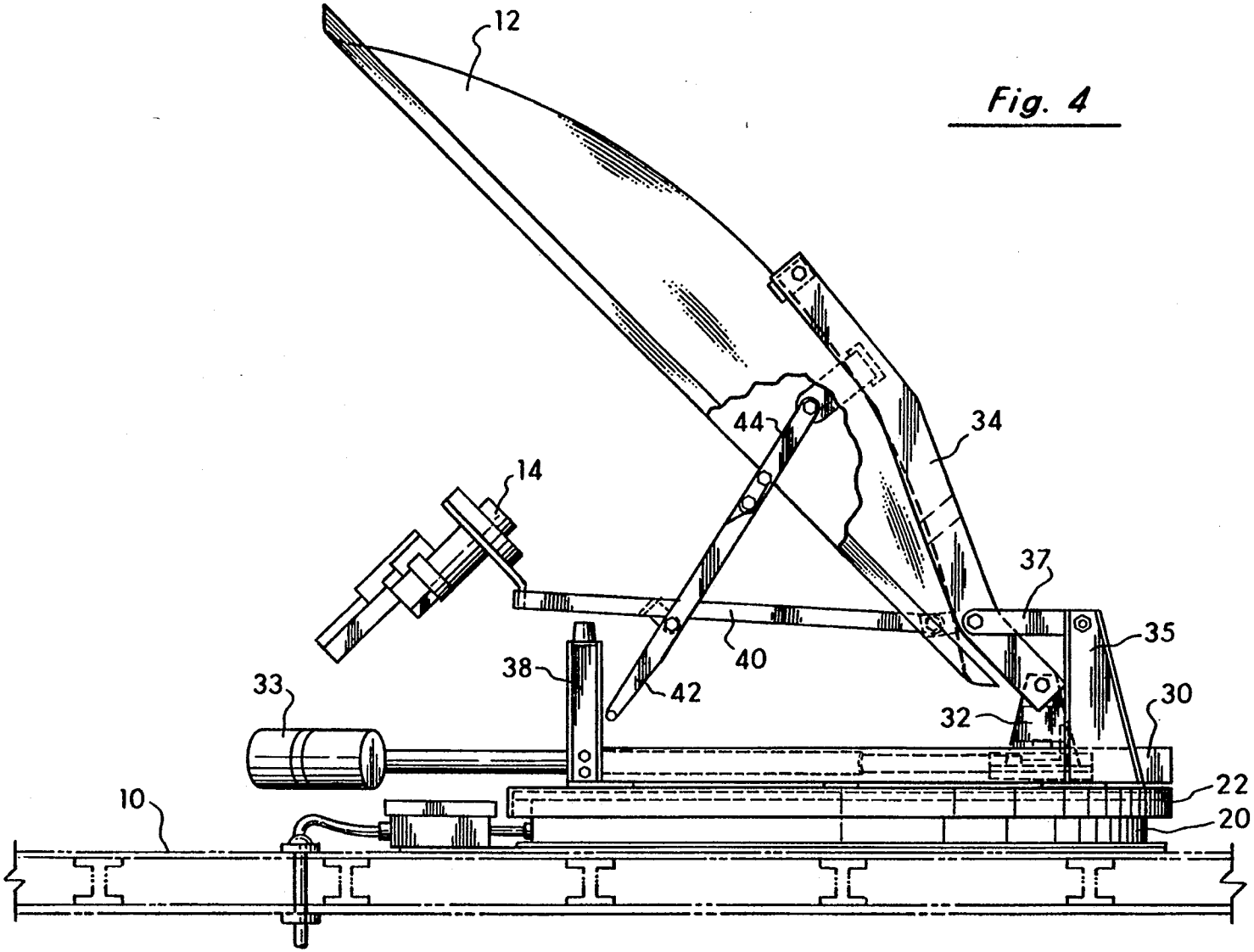
FIG. 4 is a side view of the antenna in a more fully deployed position than shown in FIG. 3.
Figure 5:
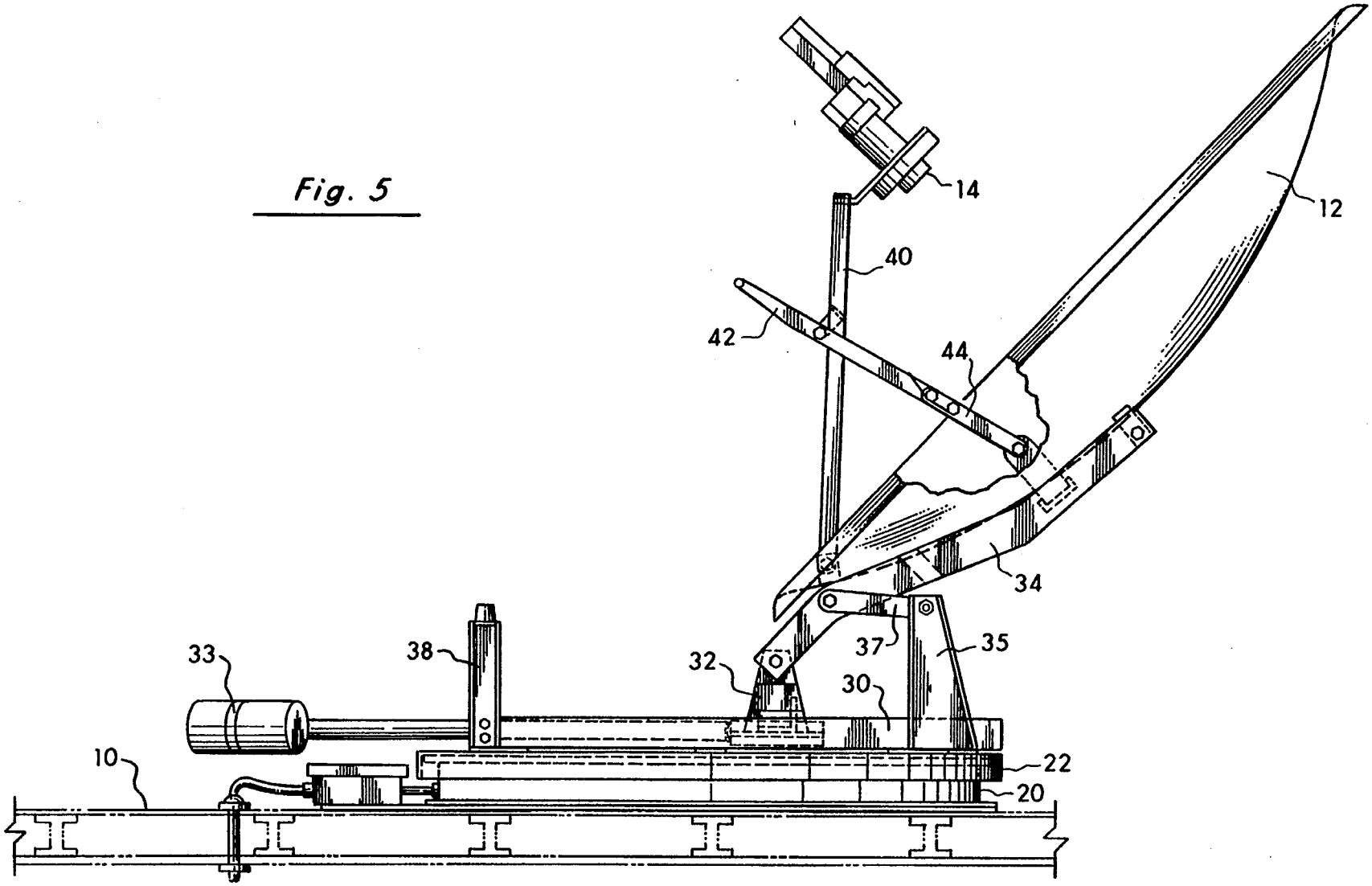
FIG. 5 is a side view of the antenna in its fully deployed position.
Figure 9:
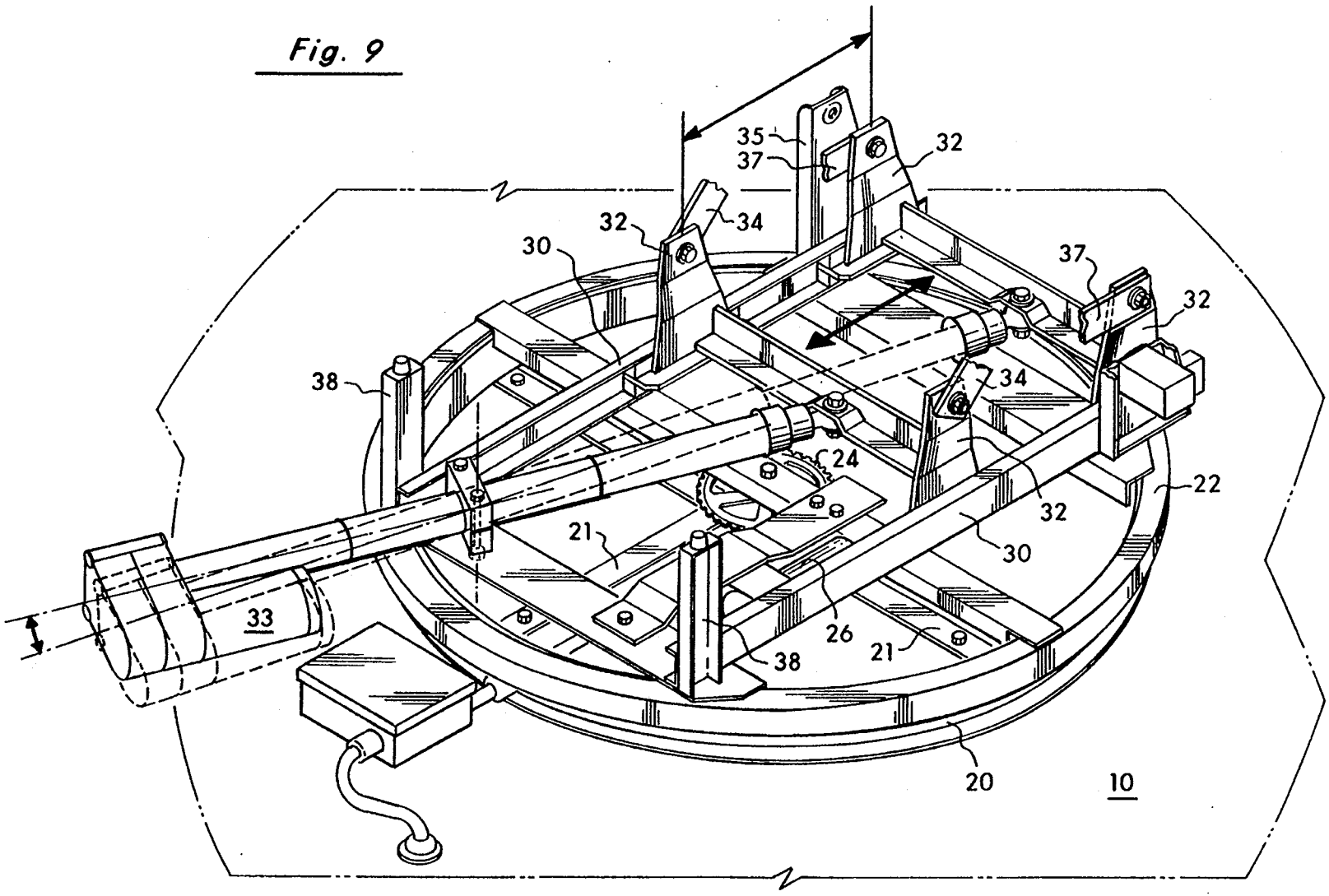
FIG. 9 is a perspective view showing the range of motion of the slide assembly and elevation control motor between the stowed position and the fully deployed position of the antenna.

FIGS. 2 through 5 demonstrate the system moving from its stowed position (FIG. 2) to its fully deployed position (FIG. 5). FIG. 9 depicts the range of motion of the slider assembly 32 with respect to the parallel tracks 30. In particular, FIG. 9 shows how the elevation control motor 33 moves the slider assembly 32 along the parallel tracks 30 toward the motor 33 in order to raise the reflector 12 from the stowed position to the deployed position. It should be noted that in the stowed position shown in FIG. 2, the slider assembly 32 is distal from the elevation control motor 33. The reflector 12 faces the roof of the vehicle 10- The end of the feed pivot arm 42 is in contact with the base of the unit, thereby causing the feed frame assembly 44 and feed horn 14 to be rotated to positions adjacent to the surface of the reflector 12 for storage. In this stowed position, the elevational control motor 33, slider assembly 32, feed horn 14, feed frame assembly 44, azimuth gear 24, and the azimuth control motor 26 are all covered by the reflector 12 to provide a degree of protection from the elements.

In FIG. 3, the elevation control motor 33 has drawn the slider assembly 32 and the proximal portion of the reflector 12 along the parallel tracks 30 to a position slightly closer to the motor 33. This slightly raises the opposite distal portion of the reflector 12 off the forward supports 38 and thereby causes a slight upward rotation of the reflector 12 as shown. However, the end of the feed pivot arm 42 remains in contact with the base of the unit. The segments 42 and 44 of the pivot arm gradually straighten as the reflector 12 rotates upward, but the feed frame assembly 40 and the feed horn 14 are not yet lifted from their stowed positions.

FIG. 4 continues the deployment process to the point where the end of the feed pivot arm 42 is no longer in contact with the base of the unit. The slider assembly 32 and the proximal portion of the reflector 12 have been moved closer to the elevation control motor 33 and the face of the reflector 12 has thereby been rotated upward to a greater elevational angle. The segments 42 and 44 of the feed pivot a have straightened to a co-linear relationship with one another, and lift the feed frame assembly 40 and the feed horn 14 from their stowed positions by rotating the feed frame assembly 40 about its base attached to the face of the reflector 12. The feed horn 14 is now positioned at the focal point of the reflector 12.

In FIG. 5, the reflector 12 has reached its fully deployed position with the face of the reflector 12 pointed upward. The slider assembly 32 and the proximal portion of the reflector 12 have been drawn forward to their most proximal position with respect to the elevation control motor 33. The two segments 42 and 44 of the feed pivot arm remain in a co-linear relationship due to the spring mechanism. The feed horn 14 remains positioned at the focal point of the reflector 12 as before. The procedure shown in FIGS. 2 through 5 is simply reversed to stow the antenna.

The above disclosure sets forth a number of embodiments of the present invention. Other arrangements or embodiments, not precisely set forth, could be practiced under the teachings of the present invention and as set forth in the following claims.

We claim:

1. A deployable antenna system to be mounted on a support surface, said antenna system comprising:

a reflector having a face, a focal point, a proximal portion adjacent said support surface, and a distal portion that is remote from said support surface when said antenna system is deployed;

a feed horn for receiving electrical signals reflected by said reflector;

azimuth control means for rotating said reflector in an azimuth direction with respect to said support surface; and elevation control means coupled to said azimuth control means and to said reflector for raising said reflector in an elevational direction having;

(a) a track substantially parallel to said support surface;

(b) slider means for translational movement along said track;

(c) a reflector frame having a lower portion pivotally attached to said slider means and an upper portion attached to said reflector;

(d) a reflector pivot arm having a first portion pivotally attached with respect to said reflector and a second portion pivotally attached to a predetermined point relative to said track; and (e) means for adjustably controlling the position of said slider means along said track between said stowed position and said deployed position, thereby causing the proximal portion of said reflector to slide in a direction across said azimuth control means to raise the distal portion of said reflector from a stowed position wherein said reflector faces said support surface to a deployed position wherein said reflector faces upward.

2. The antenna system of claim 1 wherein said support surface comprises the roof of a vehicle.

3. The antenna system of claim 1 wherein said antenna system further comprises:

a feed frame having a base portion pivotally attached to said reflector and a distal portion supporting said feed horn, said feed frame stowing said feed horn beneath said reflector in said stowed position and moving said feed horn to said focal point when not in said stowed position; and a feed pivot arm connected to said feed frame having a first end pivotally attached to said reflector and a distal end which contacts a portion of said antenna system as said reflector reaches its stowed position to pivot said feed frame about its base portion and stow said feed horn adjacent to said face of said reflector.

4. The antenna system of claim 1 wherein said azimuth control means comprise:

a stationary ring mounted to said support surface;

an azimuth ring supported by said stationary ring for rotation about an azimuth axis; and drive means for selectively rotating said azimuth ring to a desired orientation about said azimuth axis.

5. A deployable antenna system to be mounted on a vehicle or the like, said antenna system comprising:

a base mounted to said vehicle;

a reflector having a face and a focal point;

a feed horn for receiving electrical signals reflected by said reflector; and an elevation control assembly for supporting said reflector on said base and adjustably controlling the elevational angle of said reflector, said elevational control assembly having:

(*a*) at least one parallel track;

(b) slider means for translational movement along said track;

(c) a reflector frame having a lower portion pivotally attached to said slider means and an upper portion attached to said reflector;

(d) at least one pivot arm, each having a first portion pivotally attached with respect to said reflector and a second portion pivotally attached to said base; and (e) means for adjustably controlling the position of said slider means along said track between a stowed position in which said reflector is stowed facing said vehicle and a deployed position in which said reflector is rotated to a maximum elevational angle.

6. The antenna system of claim 5 further comprising azimuth control means for supporting and adjustably controlling rotation of said reflector with respect to said base about an azimuth axis.

7. The antenna system of claim 6 wherein said azimuth control means comprise:

a platform supported by said base for rotation about said azimuth axis; and drive means for selectively rotating said platform to a desired orientation about said azimuth axis.

8. The antenna system of claim 5 wherein said second portion of said pivot arm is pivotally attached to a support extending upward from said base toward said reflector adjacent to said parallel track.

9. The antenna system of claim 5 wherein said antenna system further comprises:

a feed frame having a base portion pivotally attached to said reflector and a distal portion supporting said feed horn, said feed frame stowing said feed horn beneath said reflector in said stowed position and moving said feed horn to said focal point when not in said stowed position; and a feed pivot arm connected to said feed frame having a first end pivotally attached relative to said reflector and a distal end which contacts said base as said reflector reaches its stowed position to pivot said feed frame about its base portion and stow said feed horn beneath said reflector.

10. The antenna system of claim 9 wherein said feed pivot arm comprises:

a first segment having a first end pivotally attached to said reflector and further having a distal end;

a second segment having a first end pivotally attached to said distal end of said first segment, a midsection pivotally connected to said feed frame, and a distal end; and spring means connected between said first segment and said second segment exerting a force which tends to keep said second segment extended from said first segment.

11. A deployable antenna system to be mounted on a vehicle or the like, said antenna system comprising:

a base mounted to said vehicle;

a platform supported by said base for rotation about an azimuth axis;

drive means for selectively rotating said platform to a desired orientation about said azimuth axis a reflector having a focal point;

an elevation control assembly for supporting said reflector on said platform and adjustably controlling the elevational angle of said reflector, said elevation control assembly having:

(a) at least one parallel track;

(b) slider means for translational movement along said track;

(c) a reflector frame having a lower portion pivotally attached to said slider means and an upper portion attached to said reflector;

(d) at least one reflector pivot arm, each having a first portion pivotally attached with respect to said reflector and a second portion pivotally attached to a predetermined point relative to said parallel track; and (e) means for adjustably controlling the position of said slider means along said track between a stowed position in which said reflector is stowed facing said vehicle and a deployed position in which said reflector is rotated to a maximum elevational angle;

a feed horn for receiving electrical signals;

a feed frame having a base portion pivotally attached with respect to said reflector and a distal portion supporting said feed horn, said feed frame stowing said feed horn beneath said reflector in said stowed position and moving said feed horn to said focal point when not in said stowed position; and a feed pivot arm connected to said feed frame having a first end pivotally attached relative to said reflector and a distal end which is contacted as said reflector reaches said stowed position to pivot said feed frame about its base portion and stow said feed horn beneath said reflector.

12. The antenna system of claim 11 wherein said feed pivot arm comprises:

a first segment having a first end pivotally attached to said reflector and further having a distal end;

a second segment having a first end pivotally attached to said distal end of said first segment, a midsection pivotally connected to said feed frame, and a distal end; and spring means connected between said first segment and said second segment exerting a force which tends to keep said second segment extended from said first segment.

13. The antenna system of claim 11, wherein said second portion of each reflector pivot arm is pivotally attached to a support extending upward from said platform toward said reflector adjacent to a corresponding one of said parallel tracks.

14. A deployable antenna system to be mounted on a vehicle or the like, said antenna system comprising:

a stationary ring mounted to said vehicle;

an azimuth ring supported by said stationary ring for rotation about an azimuth axis;

drive means for selectively rotating said azimuth ring to a desired orientation about said azimuth axis;

a reflector having a focal point;

an elevation control assembly for supporting said reflector on said stationary ring and adjustably controlling the elevational angle of said reflector, said elevational control assembly having:

(a) two parallel tracks;

(b) slider means for translational movement along said tracks;

(c) a reflector frame having a lower portion pivotally attached to said slider means and an upper portion attached to said reflector;

(d) two reflector pivot arms, each having a first end pivotally attached with respect to said reflector and a second end pivotally attached to a point with respect to a corresponding one of said tracks; and (e) means for adjustably controlling the position of said slider means along said tracks between a stowed position in which said reflector is stowed facing said vehicle and a deployed position in which said reflector is rotated to a maximum elevational angle;

a feed horn for receiving electrical signals;

a feed frame having a base portion pivotally attached to said reflector and a distal portion supporting said feed horn, said feed frame stowing said feed horn beneath said reflector in said stowed position and moving said feed horn to said focal point when not in said stowed position; and a feed pivot arm having:

(a) a first segment having a first end pivotally attached relative to said reflector and further having a distal end;

(b) a second segment having a first end pivotally attached to said distal end of said first segment, a midsection pivotally connected to said feed frame, and a distal end which is contacted as said reflector reaches said stowed position to pivot said feed frame about its base portion and stow said feed horn beneath said reflector; and (c) spring means connected between said first segment and said second segment exerting a force which tends to keep said second segment extended from said first segment.

15. A deployable antenna system mounted on the roof of a recreational vehicle, said antenna system comprising:

a reflector having a face and a focal point;

azimuth control means for rotating said reflector about an azimuth axis substantially perpendicular to said roof;

a track supported by said azimuth control means extending substantially parallel to said roof;

means for translational movement along said track coupled to a first end of said reflector;

elevation control means coupled to said translational means for raising said reflector in an elevational direction with respect to said roof, said elevational control means causing said translational means and said first end of said reflector to translate along said track to raise the opposing end of said reflector from a stowed position wherein said reflector faces said roof to a deployed position in which said reflector faces upward.

16. The antenna system of claim 15 wherein said antenna system further comprises:

a feed horn for receiving electrical signals;

a feed frame having a base portion pivotally attached to said reflector and a distal portion supporting said feed horn, said feed frame stowing said feed horn beneath said reflector in said stowed position and moving said feed horn to said focal point when not in said stowed position; and a feed pivot arm connected to said feed frame having a first end pivotally attached relative to said reflector and a distal end which contacts a portion of said antenna system as said reflector reaches its stowed position to pivot said feed frame about its base portion and stow said feed horn adjacent to said face of said reflector.

17. The antenna system of claim 15 wherein said azimuth control means comprise:

a stationary ring mounted to said roof;

an azimuth ring supported by said stationary ring for rotation about an azimuth axis; and drive means for selectively rotating said azimuth ring to a desired orientation about said azimuth axis.

* * * * *